US006084352A

United States Patent [19]

Seki et al.

[11] Patent Number: 6,084,352

[45] Date of Patent: Jul. 4, 2000

[54] HIGH PRESSURE DISCHARGE LAMP WITH SEAL COATING

[75] Inventors: Tomoyuki Seki, Nagaokakyo; Kazuo Maeda, Takatsuki; Hiroshi Sugimoto, Osaka; Akira Mii, Ashiya, all of Japan

[73] Assignee: Matsushita Electronics Corporation, Osaka, Japan

[21] Appl. No.: 09/037,074

[22] Filed: Mar. 9, 1998

[51] Int. Cl.[7] ..... H01J 61/35

[52] U.S. Cl. ..... 313/635; 313/634; 313/567

[58] Field of Search ..... 313/635, 623, 313/624, 634, 243, 244, 287, 283, 284, 317, 318.01, 318.02, 318.07, 355

[56] References Cited

U.S. PATENT DOCUMENTS

| | | | |
|---|---|---|---|
| 4,047,067 | 9/1977 | Clausen | 313/221 |
| 4,171,498 | 10/1979 | Fromm et al. | 313/229 |
| 5,404,078 | 4/1995 | Bunk et al. | 313/625 |
| 5,668,440 | 9/1997 | Inukai et al. | 313/635 |
| 5,708,328 | 1/1998 | Mathews et al. | 313/573 |
| 5,742,126 | 4/1998 | Fujii et al. | 313/635 |

*Primary Examiner*—Nimeshkumar D. Patel
*Assistant Examiner*—Matthew J. Gerike
*Attorney, Agent, or Firm*—Akin, Gump, Strauss, Hauer & Feld, L.L.P.

[57] ABSTRACT

A lamp for a halogen lamp a single-tube, high-intensity discharge lamp, a double-tube high-intensity discharge lamp having an outer housing formed of quartz, and the like, being characterized in that a film having desirable heat conductivity and emissivity is formed on the surface of each sealing portion thereof, whereby the temperature at the distal end of the molybdenum foil in the sealing portion away from the center of the bulb can be kept at about 350° C. or less while the lamp is burning.

8 Claims, 6 Drawing Sheets

HIGH PRESSURE DISCHARGE LAMP WITH SEAL COATING

BACKGROUND OF THE INVENTION

The present invention relates to a lamp used for a gas-filled lamp, such as a halogen lamp, a single-tube high-intensity discharge lamp and a double-tube high-intensity discharge lamp.

A molybdenum foil is generally provided as a conductor at a sealing portion of a lamp used for a halogen lamp, a single-tube high-intensity discharge lamp, a double-tube high-intensity discharge lamp having an outer housing formed of quartz, and the like. The outer covering of the sealing portion in this kind of lamp has been formed of a transparent material such as quartz. The distal end of the molybdenum foil in the sealing portion away from the center of the bulb is exposed to the air.

In the conventional lamp having the above-mentioned structure, when the lamp is burning, the temperature of the molybdenum foil is raised abruptly by radiation heat from the lamp, conduction heat transferred through the sealing portion, heat generation due to the resistance of the molybdenum foil itself by the passage of electric current, and the like.

Since the distal end of the molybdenum foil in the sealing portion away from the center of the bulb is heated at a high temperature in the air as described above, the molybdenum foil is apt to be oxidized. When this kind of lamp is lighted for a considerable period of time, the molybdenum foil is oxidized, and the sealing portion is deteriorated, whereby the service life of the lamp is shortened.

In order to prevent the above-mentioned molybdenum foil from being oxidized, it was necessary to lower the temperature of the sealing portion to 350° C. or less, while the lamp is burning.

However, in such a conventional lamp consuming high power, its sealing portion is heated at a high temperature. Therefore, it was difficult to lower the temperature of the molybdenum foil to 350° C. or less.

In order to solve the above-mentioned problems, various cooling means have been taken for the conventional lamp. For example, its caps are provided with heat radiation fins, or its sealing portions are extremely lengthened so as to locate the molybdenum foils at the ends of the sealing portions away from the light-emitting portion.

It is necessary to have the above-mentioned cooling means for a lamp consuming high power. In particular, long sealing portions have been used for a lamp consuming 1800 W or more.

However, since the cap of the conventional lamp provided with heat radiation fins is complicated in shape, the production cost of the cap increases. In addition, the lamp provided with extremely lengthened sealing portions is difficult to produce and becomes large.

These problems have raised the production cost of the lamp even having the configuration to keep the sealing end portions at relatively low temperature. In particular, the pinch sealing method being advantageous for reducing the production cost cannot be used for such a lamp having extremely lengthened sealing portions.

BRIEF SUMMARY OF THE INVENTION

In order to solve the above-mentioned problems, the object of the present invention is to provide a lamp which can keep the temperatures at the ends of the conductive foils thereof at 350° C. or less, and can enjoy superior service life characteristics.

In order to attain the above-mentioned object, a lamp in accordance with the present invention comprises:

a bulb filled with at least a gas and having electrodes;

sealing portions including conductive foils embedded therein, said conductive foils being connected to the electrodes inside the bulb; and films formed on the surfaces of the sealing portions and made of a material satisfying a condition represented by $$a \times b > 0.1 \text{ (cal/cm·sec·° C.)}$$

where "a" is heat conductivity (cal/cm·sec·° C.), and "b" is emissivity.

Furthermore, a lamp in accordance with the present invention comprises:

a bulb having a filament;

a sealing portion including conductive foil embedded therein, said conductive foil being connected to the filament inside the bulb; and a film formed on the surface of the sealing portion and made of a material satisfying a condition represented by $$a \times b > 0.1 \text{ (cal/cm·sec·° C.)}$$

where "a" is heat conductivity (cal/cm·sec·° C.), and "b" is emissivity.

Therefore, in the lamp of the present invention, the temperatures at the ends of the sealing portions can be kept at 350° C. or less, whereby the lamp can have superior service life characteristics. In addition, the lamp of the present invention can be produced easily at less production cost than that of the conventional one.

While the novel features of the present invention are set forth particularly in the appended claims, the present invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DETAILED DESCRIPTION OF THE INVENTION

An embodiment of the lamp of the present invention will is described below.

Molybdenum foils are used as conductors at the sealing portions of the lamp of the present invention. The molybdenum foil has a tendency to be easily oxidized in the air at high temperature during the lighting. In order to avoid undesirable oxidation of the molybdenum foils, it is necessary to keep the temperatures low at the distal ends of the molybdenum foils in the sealing portions away from the center of the bulb low. The configuration of the present invention is explained below.

In the lamp of the present invention, a film formed on the sealing portions radiates heat from the lamp in order to keep the temperatures at the ends of the molybdenum foils at a predetermined temperature or less.

In addition, the lamp of the present invention having this kind of structure and featuring a long service life can be produced very easily, whereby its production cost can be reduced significantly.

Consequently, the present invention can provide an inexpensive lamp having superior service life characteristics.

Figure 1:
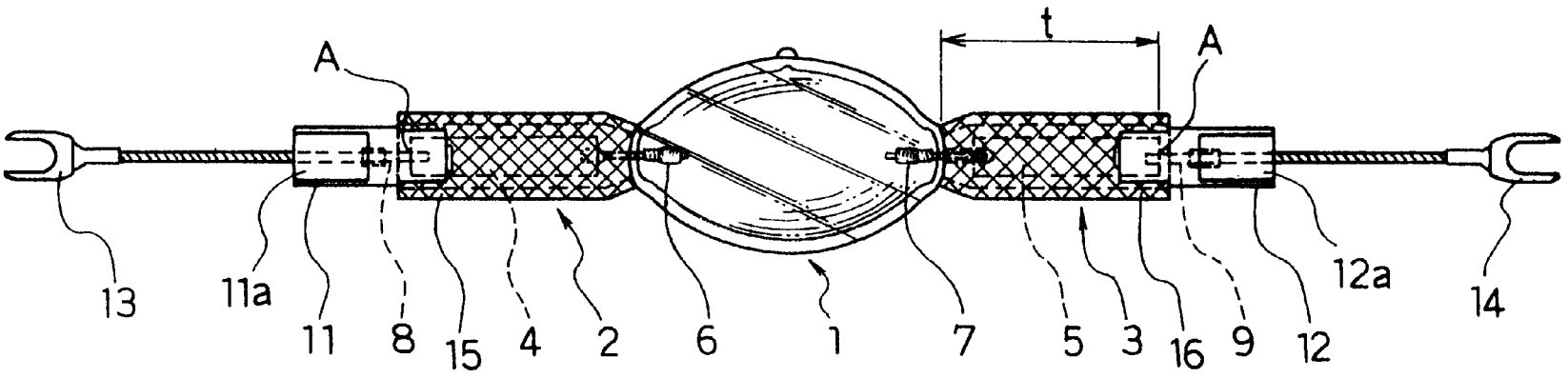
FIG. 1 is a front view showing the structure of a single-tube high-watt metal halide lamp in accordance with an embodiment of the present invention.

Preferred and concrete embodiments of the lamp of the present invention will be described below referring to the accompanying drawings. FIG. 1 is a front view showing a single-tube high-watt metal halide lamp (hereinafter simply referred to as "lamp") in accordance with an embodiment of the present invention, and FIG. 2 is a plan view showing the lamp shown in FIG. 1.

Figure 2:
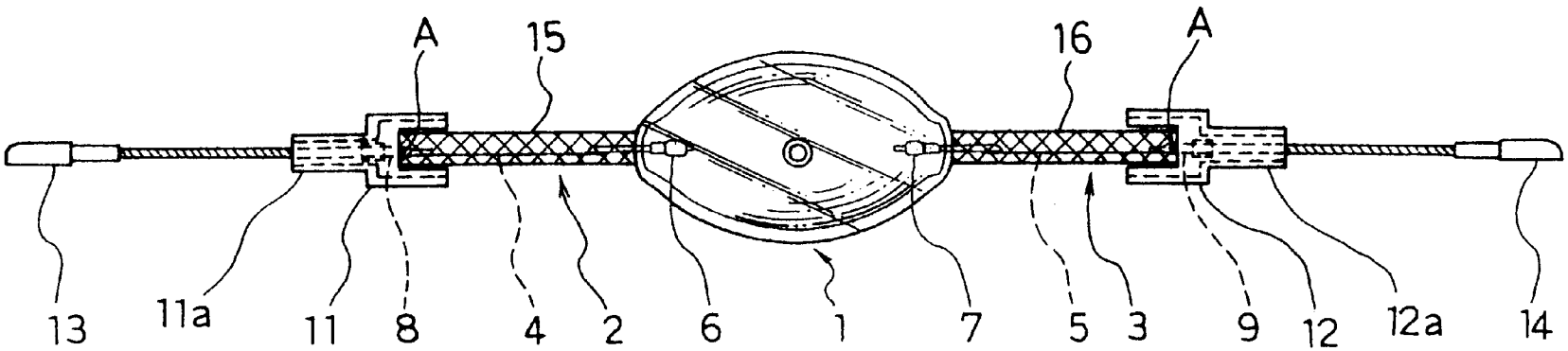
FIG. 2 is a plan view showing the single-tube high-watt metal halide lamp shown in FIG. 1.

As shown in FIGS. 1 and 2, sealing portions 2 and 3 made of quartz are formed on both sides of a discharge tube 1 by the known pinch seal method. Molybdenum foils 4, 5 as conductors are embedded in the flat-shaped sealing portions 2, 3, respectively. The distal ends of the molybdenum foils 4, 5 in the sealing portions 2, 3 away from the center of the bulb are exposed to the air. The molybdenum foils 4, 5 have a maximum thickness of 50 $\mu$m.

A starting rare gas (argon in this embodiment), mercury and metal halides are filled in the interior space of the discharge tube 1 as light-emitting substances. A pair of electrodes 6 and 7 are disposed each opposing the other in the discharge tube 1, and the electrodes 6, 7 are electrically connected to the molybdenum foils 4, 5, respectively. In addition, the molybdenum foils 4, 5 are connected, via external lead rods 8, 9 embedded in caps 11, 12 used as connection portions, respectively, to connection terminals 13, 14. Furthermore, both sides of the lead-out ends of the caps 11, 12 are formed into flat surfaces, and these flat surfaces are used as fixture socket installation portions 11*a*, 12*a*.

As shown in FIGS. 1 and 2, the sealing portions 2, 3, the molybdenum foils 4, 5, the electrodes 6, 7 and the caps 11, 12 are disposed in substantial linearlity.

Nitrided aluminum films 15, 16 are formed on the surfaces of the sealing portions 2, 3. The nitrided aluminum films 15, 16 are formed by applying with a brush a nitrided aluminum solution including water glass powder used as a binder. The lengths of the sealing portions 2, 3 in the lead-out direction (in the lateral direction in FIGS. 1 and 2) are about 40 mm. The nitrided aluminum films 15, 16 are formed on the entire surfaces of the sealing portions 2, 3. In the present invention, the average thickness of the nitrided aluminum films 15, 16 formed was 100 $\mu$m.

In the lamp having the above-mentioned structure, the temperatures at the distal ends of the molybdenum foils in the sealing portions 2, 3 away from the center of the bulb were measured while the lamp was burning. A small lighting fixture designed for projection lighting and having a front surface diameter of 47 cm (a projection area of about 1740 $cm^2$ at the front surface of the lighting fixture) was used in the temperature measurements. When the above-mentioned lamp was installed in the lighting fixture, the temperatures at the ends of the sealing portions 2, 3 were 330° C. while the lamp was burning. This temperature is desirable for preventing the molybdenum foils 4, 5 from being oxidized.

In comparison with the above-mentioned measurements, the nitrided aluminum films 15, 16 were removed from the lamp having the above-mentioned structure, and the temperatures at the ends of the sealing portions 2, 3 were measured in the same way. This temperatures were 370° C. At the temperature, there is a fear that the molybdenum foils 4, 5 may be oxidized.

Next, temperature measurements were conducted in reverse order. In other words, a lamp without being provided with the nitrided aluminum films 15, 16 was first subjected to temperature measurements, and then the lamp was provided with the nitrided aluminum films 15, 16 and subjected to temperature measurements again. Even when temperature measurements were conducted in this order, the same results as those described above were able to be obtained.

Furthermore, lamps provided with other film materials were subjected to temperature measurements. In other words, when a lamp provided with aluminum films (having an average thickness of 100 $\mu$m) was used, the temperatures at the ends of the sealing portions 2, 3 were 351° C. When a lamp provided with quartz films (having an average thickness of 100 $\mu$m) was used, however, the temperatures were 370° C.

This can be understood as follows. The sealing portions 2, 3 absorb more heat as the heat conductivity of the film material is higher, and the sealing portions 2, 3 externally discharge more heat as the emissivity of the film material is higher. Because of these reasons, the temperatures at the distal ends of the molybdenum foils 4, 5 in the sealing portions 2, 3 away from the center of the bulb were lowered while the lamp was burning. The above-mentioned emissivity is given as the a ratio between the radiant existence of a heat radiator and that of a black body measured at the same temperature.

Figure 3:
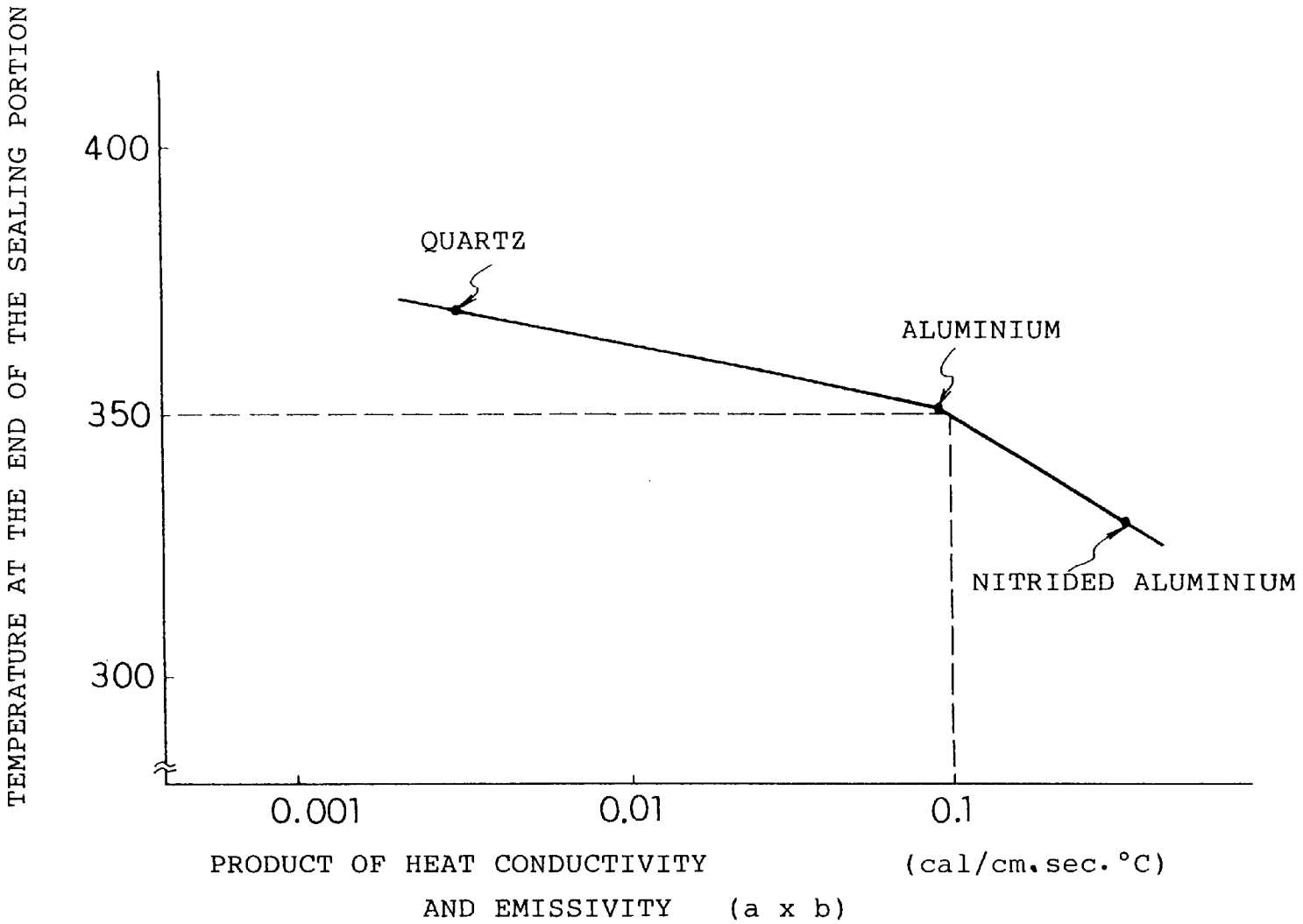
FIG. 3 is a graph showing the relationship between the product of heat conductivity a (cal/cm·sec·° C.) and emissivity b of a film material and a temperature at each sealing portion while the lamp is lighted.

FIG. 3 is a graph showing the relationship between the product (a×b) of heat conductivity "a" (cal/cm·sec·° C.) and emissivity "b" of a film material and a temperature at each end of the molybdenum foils 4, 5 in the sealing portions 2, 3 while the lamp is burning. When a condition represented by a×b>0.1 (cal/cm·sec·° C.) is satisfied, the temperatures at the ends of the sealing portions 2, 3 become about 350° C. or less as shown in FIG. 3. Therefore, the temperatures at the ends of the sealing portions 2, 3 are kept at values desirable for the molybdenum foils 4, 5 in the sealing portions 2, 3.

The lamp in accordance with the present embodiment has a power consumption in the range of 1800 W or more and 3500 W or less. Within this range, the lamp showed a significant effect of extended life time through lowering of temperatures at the sealing portions 2, 3.

Figure 4:
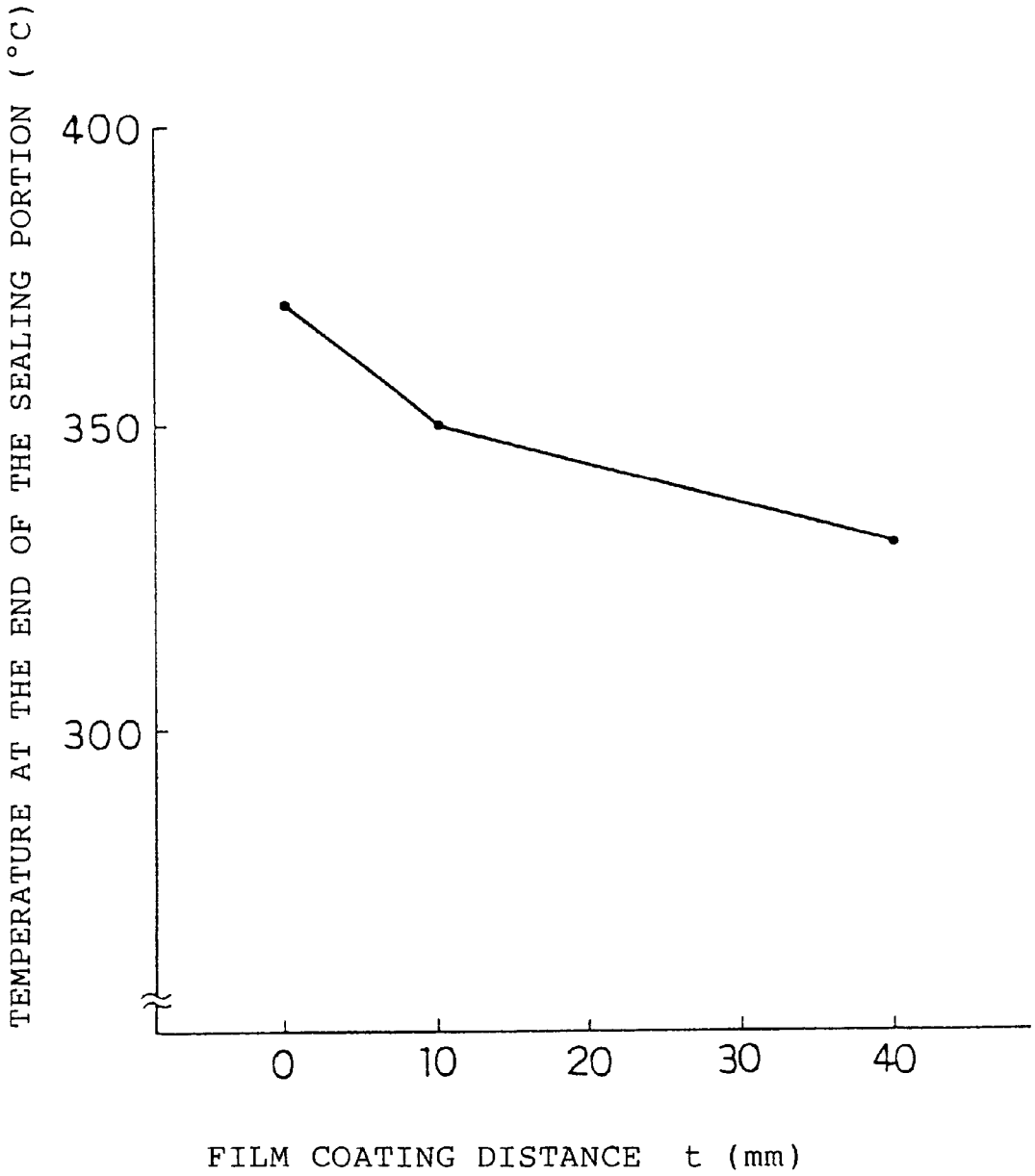
FIG. 4 is a graph showing the relationship between the film coating distance of a coating material and a temperature at each end of the sealing portions while the lamp is lighted.

The relationship between film coating length t (a film material application range) and the temperatures at the ends of the sealing portions 2, 3 are then examined as follows. As shown in FIG. 1, the film coating length t ranges from a distal end A of each of the molybdenum foils 4, 5 in the sealing portions 2, 3 away from the center of the bulb to the end of the film coating which is nearer to the center of the bulb. FIG. 4 is a graph showing the relationship between the film coating distance t (mm) and a temperature (°C.) at each end of the molybdenum foils 4, 5 in the sealing portions 2, 3 while the lamp is burning. Nitrided aluminum was used as a film material, and the same lighting fixture as that used for the above-mentioned temperature measurements relating to FIG. 3 was also used during the measurements of this time.

As shown in FIG. 4, while the lamp is burning the temperatures at the ends of the sealing portions 2, 3 becomes lower abruptly as the film coating distance t is longer. In case the film coating distance t is about 10 mm or more, the temperatures at the ends become nearly constant.

Figure 5:
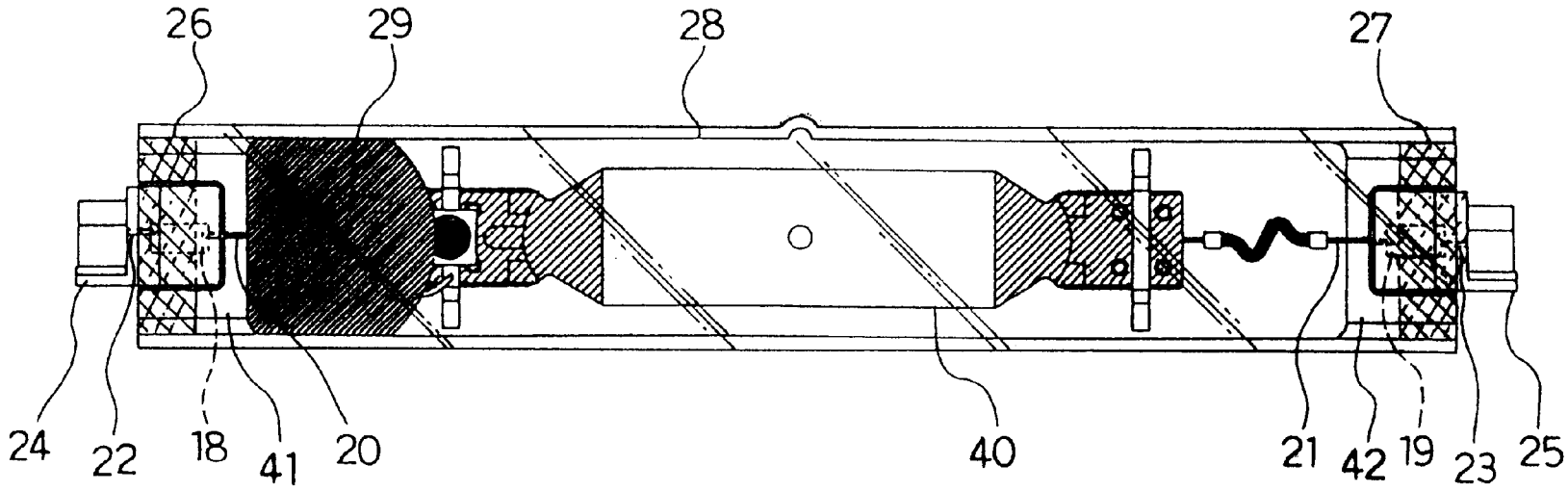
FIG. 5 is a front view showing a double-tube high-intensity discharge lamp having an outer lamp made of fused quartz in accordance with another embodiment of the present invention.

FIG. 5 is a front view showing another embodiment of the present invention. This embodiment is obtained by applying the present invention to a double-tube high-intensity discharge lamp (hereinafter simply referred to as "double-tube lamp") having an outer lamp made of fused quartz.

Referring to FIG. 5, lead rods 20, 21 are provided at both ends of a discharge tube 40 which is encapsulated in an outer tube 28. The lead rods 20, 21 are connected to outer lead rods 22, 23 via molybdenum foils 18, 19, respectively. The outer lead rods 22, 23 are electrically connected to caps 24, 25 provided outside and used as outer connection portions. As shown in FIG. 5, sealing portions 41, 42 formed of fused quartz and including the molybdenum foils 18, 19 embedded therein are provided near both ends of the outer tube 28. In addition, a getter 29 is provided near one of the ends of the outer tube 28.

In the double-tube lamp having the above-mentioned structure, nitrided aluminum films 26, 27 having high heat conductivity and high emissivity are formed on their surfaces making contact with the ends of the sealing portions 41, 42 by applying a solution containing nitrided aluminum powder thereto. By forming the nitrided aluminum films 26, 27 on the sealing portions 41, 42, the temperatures at the sealing portions 41, 42 to be raised owing to heat radiation become about 350° C. or less. Therefore, the temperatures of the sealing portions 41, 42 are maintained at a value desirable for the molybdenum foils 18, 19 in the sealing portions.

Figure 6:
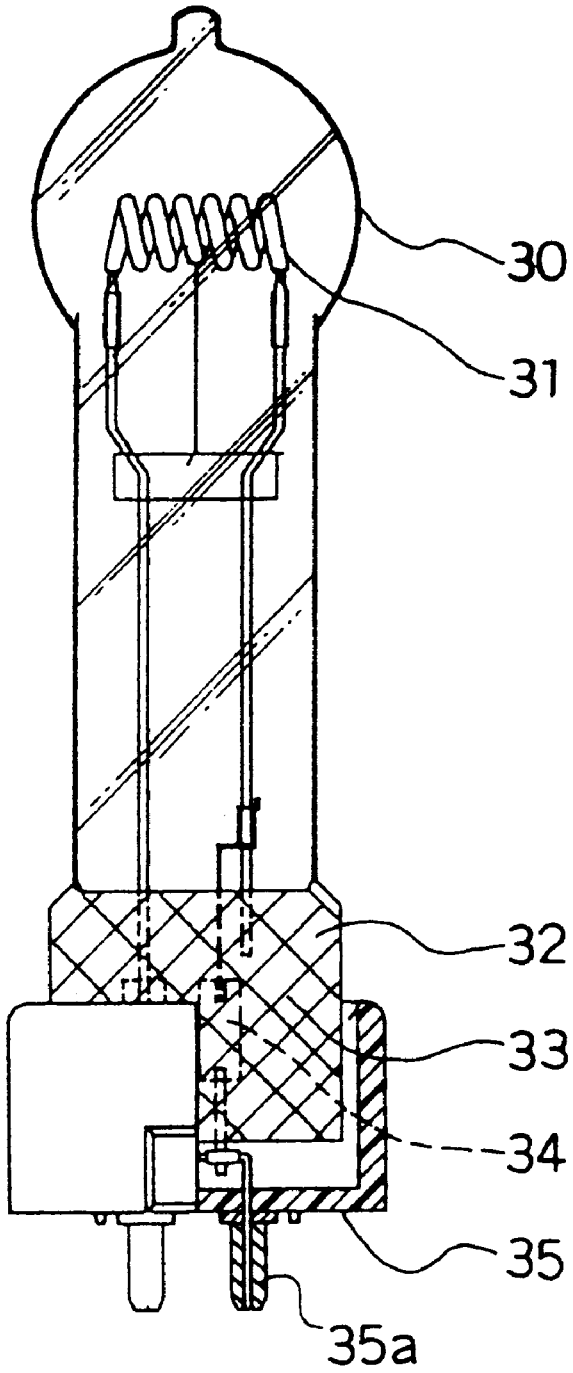
FIG. 6 is a partially cut-away front view showing a halogen lamp in accordance with still another embodiment of the present invention.

FIG. 6 is a partially cut-away front view showing a halogen lamp in accordance with still another embodiment of the present invention. In the halogen lamp shown in FIG. 6, a filament 31 inside a bulb 30 is electrically connected to the connection terminal 35*a* of a cap 35 of an insulation material used as a connection portion via a molybdenum foil 34. A sealing portion 32 including the molybdenum foil 34 embedded therein is coated with a nitrided aluminum film 33 having high heat conductivity and high emissivity. Since the nitrided aluminum film 33 is formed on the sealing portion 32 of the halogen lamp having the above-mentioned structure, the temperature at the sealing portion 32 to be raised owing to heat radiation becomes a desirable value (about 350° C.) or less. Therefore, in the halogen lamp of the present invention, the molybdenum foil 34 inside the sealing portion 32 is prevented from being oxidized, whereby the lamp can have a long service life.

As described above, According to the present invention, the temperatures at the sealing portions can be kept at 350° C. or lower while the lamp is burning, by forming films having high heat conductivity and high emissivity on the sealing portions. Furthermore, the sealing portions can be produced easily. Consequently, the present invention can provide a lamp at low cost and the lamp has a superior service life characteristics.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A lamp comprising:

a glass bulb filled with at least a gas and having electrodes;

sealing portions including conductive foils embedded therein, said conductive foils being connected to said electrodes inside said bulb; and a film coating formed only on the surfaces of said sealing portions and made of a material satisfying a condition represented by $$a \times b > 0.1 \text{ (cal/cm·sec ° C.)}$$

where "a" is heat conductivity (cal/cm·sec ° C.), and "b" is emissivity.

2. A lamp in accordance with claim 1, wherein said lamp is a single-tube high-watt high-intensity discharge lamp.

3. A lamp having a power consumption in the range of between 1800 W and 3500 W, comprising:

a glass bulb filled with at least a gas and having electrodes;

sealing portions including conductive foils embedded therein, said conductive foils being connected to said electrodes inside said bulb; and a film coating formed only on the surfaces of said sealing portions and made of a material satisfying a condition represented by $$a \times b > 0.1 \text{ (cal/cm·sec ° C.)}$$

where "a" is heat conductivity (cal/cm·sec ° C.) and "b" is emissivity.

4. A single-tube high-watt high-intensity discharge lamp having a power consumption in the range of between 1800 W and 3500 W, comprising:

a glass bulb filled with at least a gas and having electrodes;

sealing portions including conductive foils embedded therein, said conductive foils being connected to said electrodes inside said bulb; and a film coating formed only on the surfaces of said sealing portions and made of a material satisfying a condition represented by $$a \times b > 0.1 \text{ (cal/cm·sec ° C.)}$$

where "a" is heat conductivity (cal/cm·sec ° C.), and "b" is emissivity.

5. A lamp in accordance with claim 1, wherein said film is a nitrided aluminum film.

6. A lamp in accordance with claim 1, wherein said film is formed to have a length of 10 mm or more in the direction from the distal end of said conductive foil on the outer surface of said sealing portion away from the center of said bulb to the end of the film coating which is nearer to the center of said bulb.

7. A lamp in accordance with claim 1, wherein said sealing portion has a generally flat shape.

8. A lamp comprising:

a bulb having a filament;

a sealing portion including a conductive foil (34) embedded therein, said conductive foil being connected to said filament inside said bulb; and a film formed on the surface of said sealing portion and made of a material satisfying a condition represented by $$a \times b > 0.1 \text{ (cal/cm·sec ° C.)}$$

where "a" is heat conductivity (cal/cm·sec ° C.), and "b" is emissivity.

* * * * *